US011498333B2

(12) United States Patent
Goto

(10) Patent No.: US 11,498,333 B2
(45) Date of Patent: Nov. 15, 2022

(54) ELEMENT SUBSTRATE, LIQUID DISCHARGE HEAD, AND PRINTING APPARATUS

(71) Applicant: CANON KABUSHIKI KAISHA, Tokyo (JP)

(72) Inventor: Akio Goto, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 52 days.

(21) Appl. No.: 16/928,366

(22) Filed: Jul. 14, 2020

(65) Prior Publication Data

US 2021/0016570 A1 Jan. 21, 2021

(30) Foreign Application Priority Data

Jul. 16, 2019 (JP) ..... JP2019-131396

(51) Int. Cl.
*B41J 2/14* (2006.01)
*B41J 2/045* (2006.01)
*B41J 2/05* (2006.01)

(52) U.S. Cl.
CPC ..... *B41J 2/14153* (2013.01); *B41J 2/0451* (2013.01); *B41J 2/0458* (2013.01); *B41J 2/04585* (2013.01); *B41J 2/05* (2013.01); *B41J 2/14016* (2013.01); *B41J 2/14427* (2013.01)

(58) Field of Classification Search
CPC ..... B41J 2/14153; B41J 2/14016; B41J 2/14427; B41J 2/14129; B41J 2/0451; B41J 2/0458; B41J 2/04585; B41J 2/04563; B41J 2/04588; B41J 2/05; B41J 2002/14354; B41J 2/14088; B41J 2/14112; B41J 2/1412; B41J 2/14137; B41J 2002/14185; B41J 2002/14177
See application file for complete search history.

(56) References Cited

U.S. PATENT DOCUMENTS 9,597,871 B2 3/2017 Ike
2015/0321470 A1 11/2015 Ike

FOREIGN PATENT DOCUMENTS

JP 2015-214079 A 12/2015

*Primary Examiner* — Kristal Feggins
(74) *Attorney, Agent, or Firm* — Venable LLP

(57) ABSTRACT

An element substrate, according to an embodiment of this present invention, capable of detecting the behavior of a liquid at a high sensitivity, comprises: a first electrothermal transducer configured to generate heat to discharge a liquid; at least one temperature detection element arranged near the first electrothermal transducer; and a second electrothermal transducer configured to generate heat in association with a temperature detection operation by the at least one temperature detection element.

7 Claims, 8 Drawing Sheets

ELEMENT SUBSTRATE, LIQUID DISCHARGE HEAD, AND PRINTING APPARATUS

BACKGROUND OF THE INVENTION

Field of the Invention

The present invention relates to an element substrate, a liquid discharge head, and a printing apparatus, and particularly to, for example, a printing apparatus that uses, as a printhead, a liquid discharge head incorporating an element substrate to perform printing in accordance with an inkjet method.

Description of the Related Art

A liquid discharge apparatus for discharging a liquid such as ink, which is typically represented by an inkjet printing apparatus, includes a liquid discharge head (to be referred to as a printhead hereinafter). A number of orifices are formed in the printhead. For example, ink is foamed using thermal energy generated by an electrothermal transducer, thereby discharging the ink from an orifice.

The printhead is formed by an element substrate, a liquid chamber forming member, and the like. The element substrate is provided with an electrothermal transducer, a coating layer configured to protect the electrothermal transducer, and a supply port configured to supply ink. The liquid chamber forming member is provided with an orifice (nozzle) and joined with the element substrate, thereby forming a fluid channel that makes the orifice and the supply port communicate. The surface of the coating layer is exposed to the fluid channel and functions as a heat application portion that gives thermal energy generated by the electrothermal transducer to the ink.

In the printhead, all or some nozzles of the printhead may be unable to discharge ink droplets because of foreign substance sticking to the ink discharge surface, bubbles that have entered an ink supply path or nozzle, a change in wettability of a nozzle surface, or the like. In addition, an ink discharge failure may occur in which a deviation occurs in an image formed when a discharged ink droplet lands at a position deviated from a desired position on a print medium. To avoid deterioration of image quality caused by such a discharge failure, it is desirable to quickly execute a recovery operation of recovering the ink discharge state or a complementary printing operation using another nozzle. For this purpose, it is very important to correctly judge the ink discharge state at an appropriate timing Hence, various ink discharge state judgment methods and apparatuses using these have been proposed conventionally.

Japanese Patent Laid-Open No. 2015-214079 discloses a method of detecting temperature drop caused at the time of normal discharge to detect an ink discharge failure and a configuration thereof. According to Japanese Patent Laid-Open No. 2015-214079, an electrothermal transducer configured to supply heat to a liquid, and a first temperature detection element and a second temperature detection element, which are configured to detect the temperature of the electrothermal transducer, are provided on an element substrate. In particular, at least a part of each of the first temperature detection element and the second temperature detection element are arranged immediately under a region where the electrothermal transducer is arranged, and a comparator configured to compare output voltages obtained from the temperature detection elements is provided. Using such an arrangement, it is judged based on the comparison result whether ink discharge is normal or abnormal.

At the time of normal ink discharge, a part (satellite) of a discharged ink droplet separates and drops, passes through an orifice, sticks to the surface layer of the electrothermal transducer of the element substrate, and as a result, the temperature of the temperature detection element abruptly drops. On the other hand, at the time of ink discharge failure, a state in which a part of an ink droplet drops and sticks to the surface layer of the electrothermal transducer of the element substrate is not created, and therefore, the temperature of the temperature detection element moderately lowers. Hence, the discharge state can be detected based on the difference in the temperature change.

When detecting the discharge state, power is supplied to the electrothermal transducer to heat the ink and make the temperature change steep, thereby increasing the detection accuracy. If the temperature detection region is made large, the detection accuracy can further be increased. However, if the size of the electrothermal transducer directly contributing to ink foaming is made large, discharge of small ink droplets may be difficult, and high-quality printing may be impossible.

In particular, in the arrangement in which a plurality of temperature detection elements are arranged for one electrothermal transducer, as disclosed in Japanese Patent Laid-Open No. 2015-214079, the temperature detection region assigned to each temperature detection element becomes small, and the sensitivity of liquid (ink) behavior detection becomes lower.

SUMMARY OF THE INVENTION

Accordingly, the present invention is conceived as a response to the above-described disadvantages of the conventional art.

For example, an element substrate, a liquid discharge head, and a printing apparatus according to this invention are capable of detecting the behavior of a liquid at a high sensitivity.

According to one aspect of the present invention, there is provided an element substrate comprising: a first electrothermal transducer configured to generate heat to discharge a liquid; at least one temperature detection element arranged near the first electrothermal transducer; and a second electrothermal transducer configured to generate heat in association with a temperature detection operation by the at least one temperature detection element.

According to another aspect of the present invention, there is provided a liquid discharge head comprising: an element substrate including a plurality of first electrothermal transducers configured to generate heat to discharge a liquid, at least one temperature detection element arranged near each of the plurality first electrothermal transducers, and a second electrothermal transducer configured to generate heat in association with a temperature detection operation by the at least one temperature detection element; and a plurality of orifices configured to discharge the liquid in correspondence with the plurality of first electrothermal transducers.

According to another aspect of the present invention, there is provided a printing apparatus for printing on a print medium comprising: a liquid discharge head, which is used as a printhead configured to discharge ink as a liquid, comprising an element substrate including a plurality of first electrothermal transducers configured to generate heat to discharge the liquid, at least one temperature detection element arranged near each of the plurality of first electrothermal transducers, and a second electrothermal transducer configured to generate heat in association with a temperature detection operation by the at least one temperature detection element, and a plurality of orifices configured to discharge the liquid in correspondence with the plurality of first electrothermal transducers; and a control unit configured to drive the plurality of first electrothermal transducers to perform an ink discharge operation and detect an ink discharge state based on a result of temperature detection by the temperature detection element.

The invention is particularly advantageous since it is possible to detect the behavior of a liquid, for example, ink at a high sensitivity.

Further features of the present invention will become apparent from the following description of exemplary embodiments (with reference to the attached drawings).

DESCRIPTION OF THE EMBODIMENTS

Figure 1:
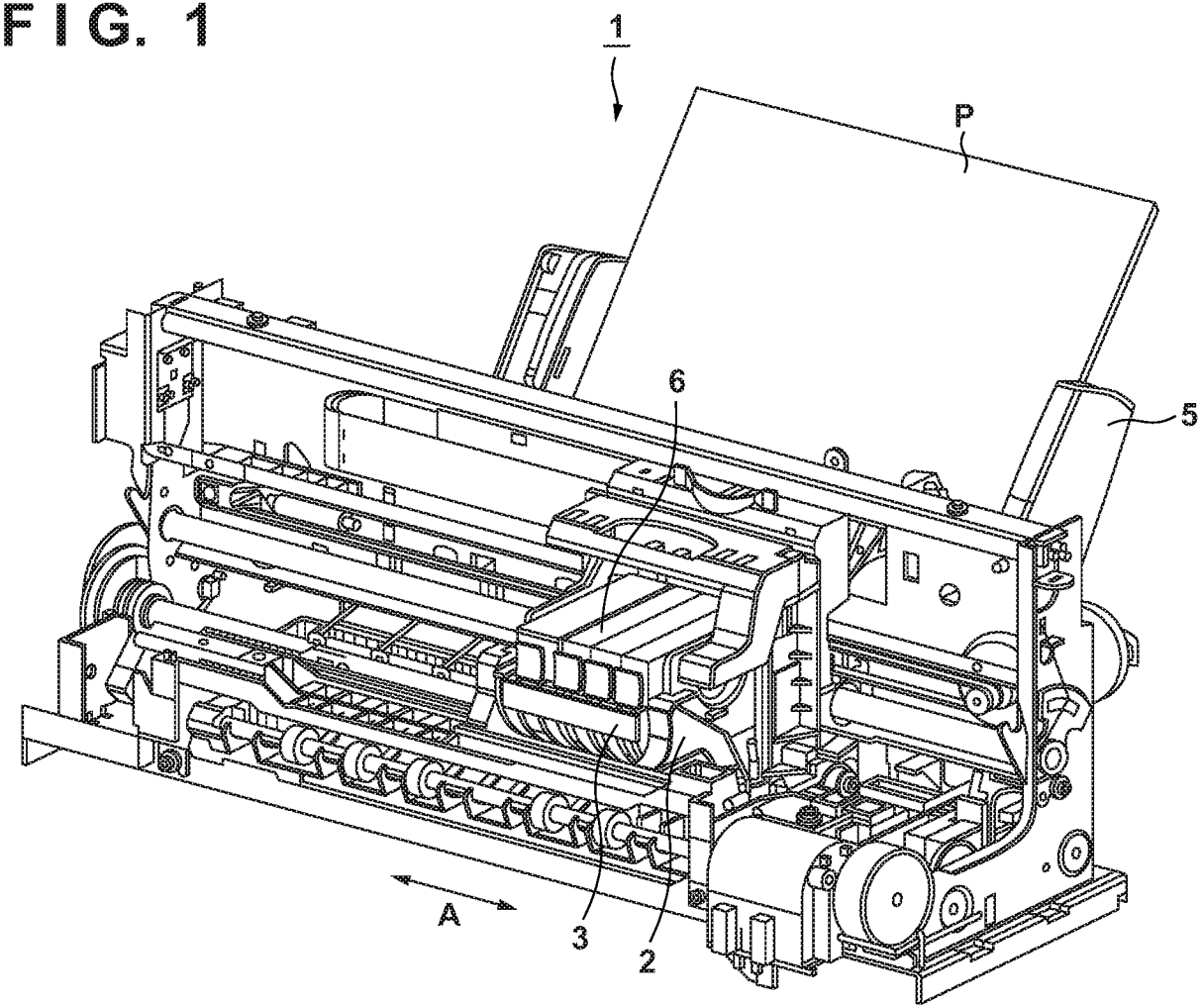
FIG. 1 is a perspective view showing the schematic arrangement of a printing apparatus including a printhead according to an exemplary embodiment of the present invention.

Exemplary embodiments of the present invention will now be described in detail in accordance with the accompanying drawings. It should be noted that the following embodiments are not intended to limit the scope of the appended claims. A plurality of features are described in the embodiments. Not all the plurality of features are necessarily essential to the present invention, and the plurality of features may arbitrarily be combined. In addition, the same reference numerals denote the same or similar parts throughout the accompanying drawings, and a repetitive description will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "print element" (to be also referred to as "nozzle" hereinafter) generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Description of Outline of Printing Apparatus (FIGS. 1 and 2)>

FIG. 1 is an external perspective view showing the outline of the arrangement of a printing apparatus that performs printing using an inkjet printhead (to be referred to as a printhead hereinafter) according to an exemplary embodiment of the present invention.

As shown in FIG. 1, in an inkjet printing apparatus (to be referred to as a printing apparatus hereinafter) 1, an inkjet printhead (to be referred to as a printhead hereinafter) 3 configured to discharge ink in accordance with an inkjet method to perform printing is mounted on a carriage 2. The carriage 2 is reciprocally moved in the direction of an arrow A to perform printing. A print medium P such as print paper is fed via a paper feed mechanism 5, conveyed to a printing position, and ink is discharged from the printhead 3 to the print medium P at the printing position, thereby performing printing.

In addition to the printhead 3, an ink tank 6 storing ink to be supplied to the printhead 3 is attached to the carriage 2 of the printing apparatus 1. The ink tank 6 is detachable from the carriage 2.

A printing apparatus 1 shown in FIG. 1 can perform color printing, and for the purpose, four ink cartridges storing magenta (M), cyan (C), yellow (Y), and black (K) inks, respectively, are mounted on the carriage 2. The four ink cartridges are detachable independently.

The printhead 3 according to this embodiment employs an inkjet method of discharging ink using thermal energy. Hence, the printhead 3 includes an electrothermal transducer (heater). The electrothermal transducer is provided in correspondence with each orifice. A pulse voltage is applied to a corresponding electrothermal transducer in accordance with a print signal, thereby discharging ink from a corresponding orifice. Note that the printing apparatus is not limited to the above-described serial type printing apparatus, and the embodiment can also be applied to a so-called full line type printing apparatus in which a printhead (line head) with orifices arrayed in the widthwise direction of a print medium is arranged in the conveyance direction of the print medium.

Figure 2:
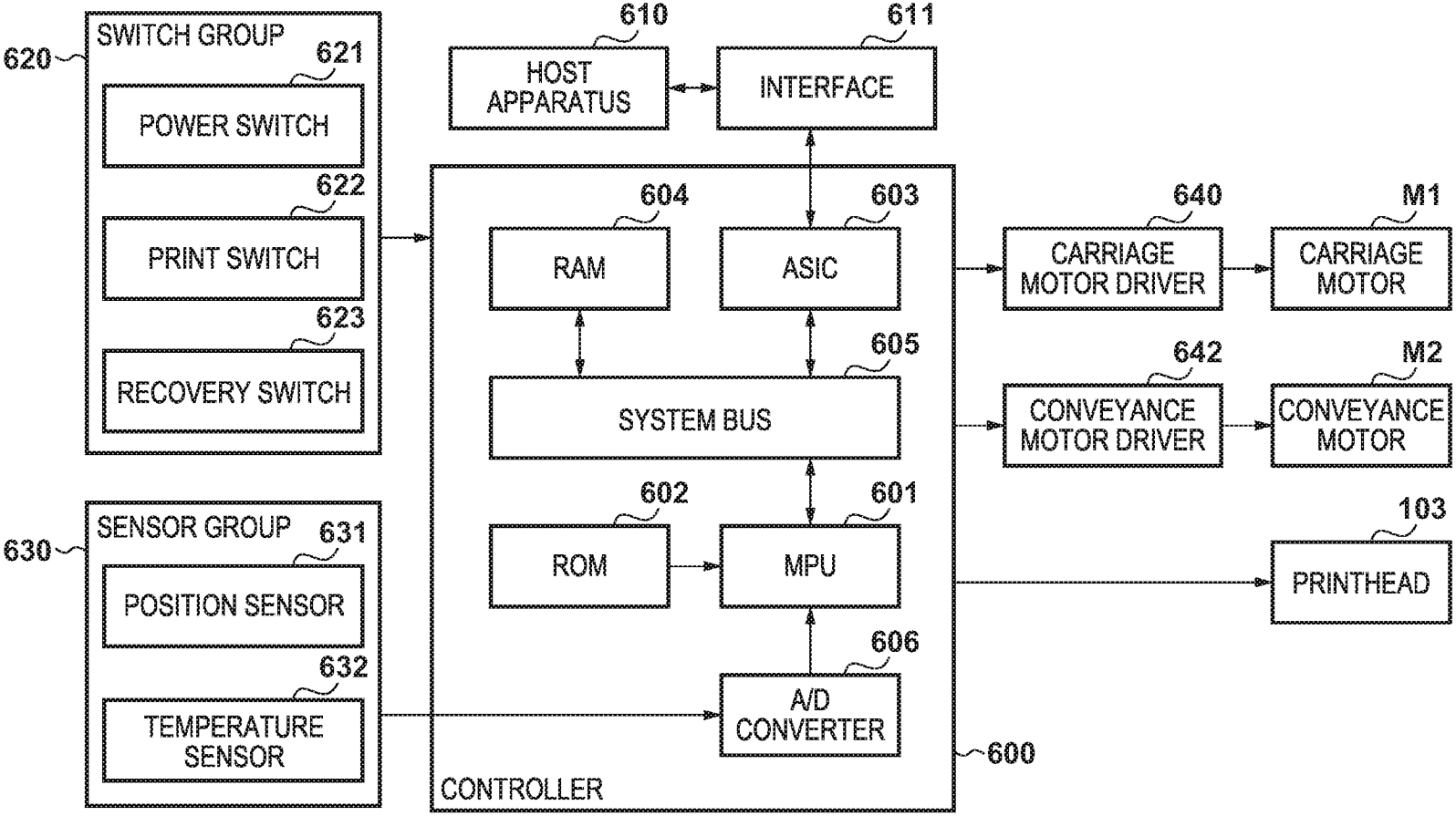
FIG. 2 is a block diagram showing the control configuration of the printing apparatus shown in FIG. 1.

FIG. 2 is a block diagram showing the control configuration of the printing apparatus shown in FIG. 1.

As shown in FIG. 2, a controller 600 is formed by an MPU 601, a ROM 602, an application specific integrated circuit (ASIC) 603, a RAM 604, a system bus 605, an A/D converter 606, and the like. Here, the ROM 602 stores programs corresponding to control sequences, necessary tables, and other fixed data. The ASIC 603 generates control signals for control of a carriage motor M1, control of a conveyance motor M2, and control of the printhead 3. The RAM 604 is used as an image data expansion area, a working area for program execution, and the like. The system bus 605 connects the MPU 601, the ASIC 603, and the RAM 604 to each other to exchange data. The A/D converter 606 receives an analog signal from a sensor group to be described below, performs A/D conversion, and supplies a digital signal to the MPU 601.

Additionally, referring to FIG. 2, reference numeral 610 denotes a host apparatus corresponding to a host shown in FIG. 1 or an MFP, which serves as an image data supply source. Image data, commands, statuses, and the like are transmitted/received by packet communication between the host apparatus 610 and the printing apparatus 1 via an interface (I/F) 611. Note that as the interface 611, a USB interface may be provided independently of a network interface to receive bit data or raster data serially transferred from the host.

Reference numeral 620 denotes a switch group which is formed by a power switch 621, a print switch 622, a recovery switch 623, and the like.

Reference numeral 630 denotes a sensor group configured to detect an apparatus state and formed by a position sensor 631, a temperature sensor 632, and the like.

Reference numeral 640 denotes a carriage motor driver that drives the carriage motor M1 configured to reciprocally scan the carriage 2 in the direction of the arrow A; and 642, a conveyance motor driver that drives the conveyance motor M2 configured to convey the print medium P.

The ASIC 603 transfers data used to drive an electrothermal transducer (a heater for ink discharge) to the printhead while directly accessing the storage area of the RAM 604 at the time of print scan by the printhead 3. In addition, the printing apparatus includes a display unit formed by an LCD or an LED as a user interface.

<Drive Configuration of Printhead and Description of Outline of Printhead (FIGS. 3 to 5C)>

Figure 3:
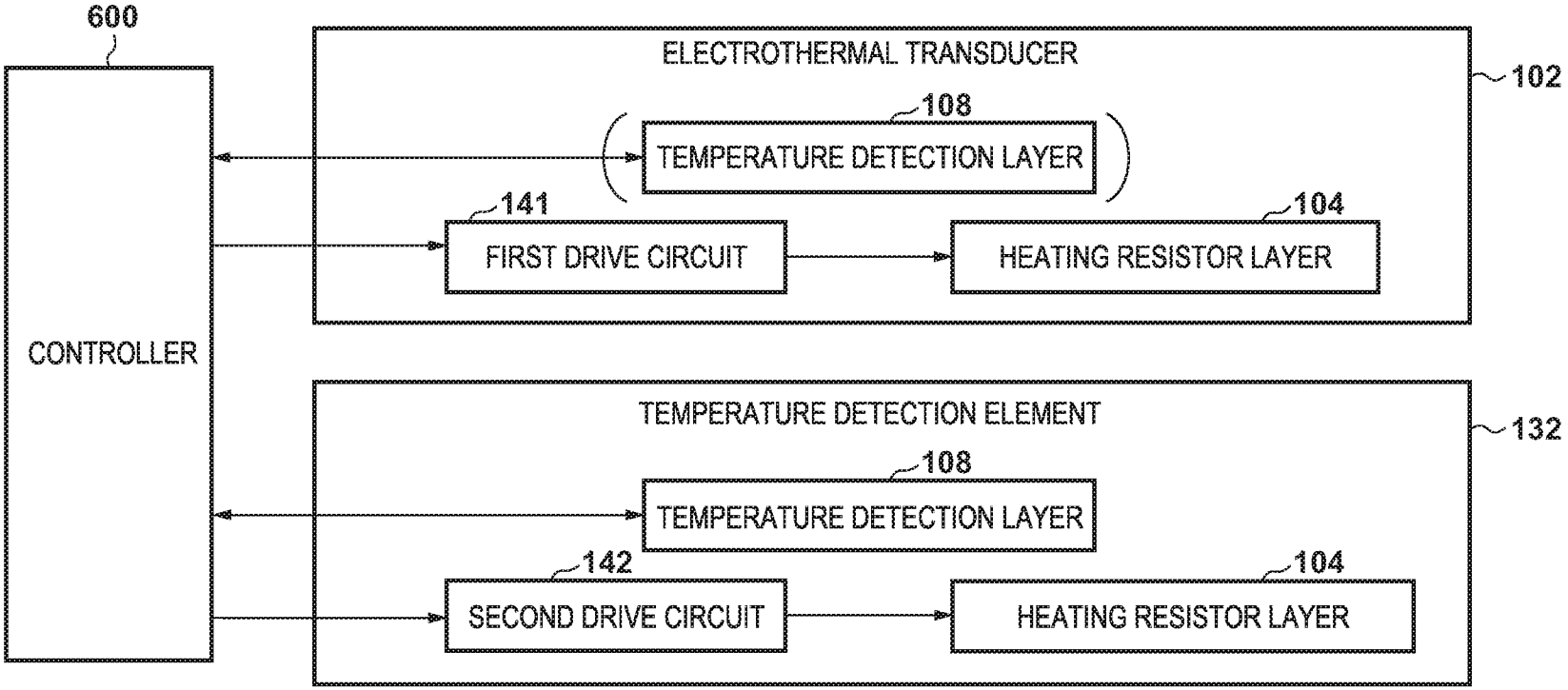
FIG. 3 is a block diagram for explaining the drive configuration of one printing element (nozzle) of the printhead.

FIG. 3 is a block diagram for explaining the drive configuration of one printing element (nozzle) of the printhead.

The controller (control unit) 600 of the printing apparatus 1 determines the behavior of a liquid (ink) based on temperature information output from a temperature detection element 132 or an electrothermal transducer 102, and gives, to a first drive circuit 141, a heat pulse to obtain an optimum drive condition. The optimum drive condition is to drive such that, for example, an adjacent nozzle does not perform discharge, or a complementary operation is performed if the discharge deviates.

If the behavior information of the ink is needed, the controller 600 gives a pulse to a second drive circuit 142 at a timing obtained by adding an offset to the pulse to the first drive circuit 141. In addition, an inspection start signal is synchronously given to the temperature detection element 132, thereby causing it to output temperature information (a result of temperature detection). In accordance with the input pulse signal, each drive circuit energizes and drives a heating resistor layer 104 of a corresponding element.

Note that in the arrangement shown in FIG. 3, the electrothermal transducer 102 and the temperature detection element 132 include the first drive circuit 141 and the second drive circuit 142, respectively. However, these drive circuits may be provided outside the elements. In this case, the drive circuits may be integrated on an element substrate incorporated in the printhead to be described later, or may be provided as drive circuits between the printhead 3 and the controller 600.

In the following embodiment, an example in which a temperature detection layer 108 is formed in the electrothermal transducer 102 will be described. However, an element substrate in which the temperature detection layer 108 is not formed under the heating resistor layer 104 of the electrothermal transducer 102 can also be used.

Figure 4A:
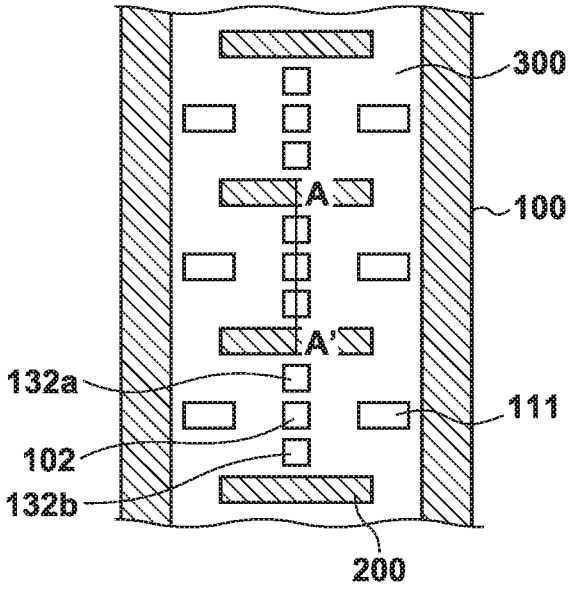
FIGS. 4A and 4B are views for explaining the structure of the printhead.
Figure 4B:
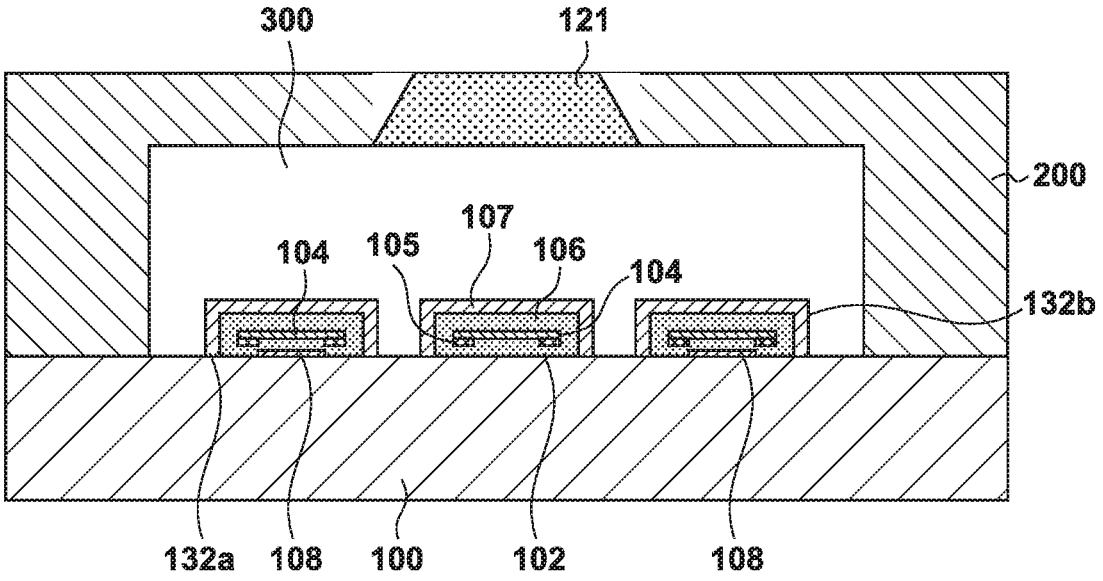

FIGS. 4A and 4B are views for explaining the structure of the printhead. The printhead 3 incorporates an element substrate 100 on which a plurality of printing elements are formed.

FIG. 4A is a perspective plan view showing the internal arrangement of three printing elements (nozzles) of the printhead 3 viewed from the upper side, and FIG. 4B is a sectional view taken along a line A-A' in FIG. 4A. Note that a vertical relationship to be described below represents a relative positional relationship in the section. If the attachment direction of the printhead is reversed, the vertical relationship is also reversed. In the example shown in FIG. 4A, since a plurality of nozzles are arranged in the direction along the line A-A', this direction is the nozzle array direction.

As shown in FIG. 4A, each printing element provided on the element substrate 100 is provided with a liquid chamber forming member 200, and a liquid chamber 300 surrounded by the liquid chamber forming member 200 is formed. The liquid chamber 300 is provided with supply ports 111 configured to supply ink, the electrothermal transducers 102, and the temperature detection elements 132. In the element substrate 100, thin films are formed into a multilayer structure on a silicon (Si) substrate or the like. Note that the supply port 111 is a through-hole extending through the element substrate 100.

In this example, two temperature detection elements 132*a* and 132*b* are arranged along the line A-A' on both sides of one electrothermal transducer 102.

As shown in FIG. 4B, the electrothermal transducer 102 is formed by connecting wiring layers 105 to the heating resistor layer 104 of TaSiN or the like. That is, a portion of the heating resistor layer 104 located between at least a pair of wiring layers 105 formed under the heating resistor layer 104 functions as the heat generation portion of the electrothermal transducer 102. The heating resistor layer 104 of the electrothermal transducer 102 will be referred to as a "first electrothermal transducer" hereinafter.

In the example shown in FIG. 4B, the wiring layers 105 are provided under the heating resistor layer 104. Conversely, the wiring layers 105 may be provided on the heating resistor layer 104. The wiring layers 105 and the heating resistor layer 104 may be connected via electric connecting members such as a plug. The wiring layer 105 is a wiring that electrically connects the heating resistor layer 104 and an external electrode (not shown), and is formed using a material having conductivity. The first electrothermal transducer is connected, via the wiring layers 105, to the first drive circuit configured to supply power that changes over time. The first drive circuit controls (ON/OFF) power supply to the first electrothermal transducer in accordance with a signal from the controller 600. The wiring layer 105 extends from the first drive circuit to an end of the element substrate of the printhead 3, and its distal end forms an external electrode used to make electrical connection to the outside. Note that the first drive circuit may be provided not on the element substrate 100 but outside the element substrate 100.

In addition, the electrothermal transducer 102 is provided on the element substrate 100. However, the electrothermal transducer 102 may not be in contact with the element substrate 100, or may float with respect to the element substrate 100. In addition, a heat storage layer made of an SiO film or a BPSG film that is contact with the element substrate 100 and prevents dissipation of heat may be provided in the lowermost layer of the electrothermal transducer 102. The electrothermal transducer 102 may include the temperature detection layer 108 to be described later.

The liquid chamber forming member 200 is made of a resin, a metal, or an inorganic material. As the resin, for example, a photosensitive resin such as an epoxy resin can be used. As the metal, for example, an SUS plate can be used. As the inorganic material, SiN, SiC, SiCN, or the like can be used.

FIGS. 4A and 4B show an example in which the liquid chamber forming member 200 is made of a resin. The liquid chamber forming member 200 is not limited to a single layer, and may be formed by multiple layers. If the liquid chamber forming member 200 is formed by multiple layers, an adhesion improving layer configured to improve adhesion to the element substrate 100 may be provided as the lowermost layer of the liquid chamber forming member 200.

As shown in FIG. 4B, an orifice 121 configured to discharge ink is formed in the liquid chamber forming member 200 so as to communicate with the liquid chamber 300. The ink supplied from the ink tank 6 to the liquid chamber 300 via the supply ports 111 is given thermal energy by the electrothermal transducer 102 and discharged from the orifice 121.

A protection layer 106 is provided between the heating resistor layer 104 and the wiring layer 105, and another layer, and functions as an insulating layer made of an SiO film, an SiN film, or the like. An upper protection layer 107 is provided on the protection layer 106 and protects the electrothermal transducer 102 from chemical and physical influences that occur in foaming and defoaming of the ink. If only the protection layer 106 suffices for the protection, the upper protection layer 107 may be absent. If the upper protection layer 107 is provided, it is made of a metal film of Ta, Ir, or the like. The protection layer 106 and the upper protection layer 107 each may be formed by a single layer or by stacking a plurality of layers.

Furthermore, as shown in FIG. 4B, the sectional structure of the temperature detection elements 132*a* and 132*b* is the same as the electrothermal transducer 102 except that the temperature detection layer 108 is provided. However, some layers may be omitted as needed. An example of the layer that can be omitted is the upper protection layer 107 in a planar arrangement without chemical and physical influences that occur in foaming and defoaming of the ink. This is because the influences occurring in foaming and defoaming of the ink are small, unlike the electrothermal transducer 102. If the upper protection layer 107 is omitted, the distance between the temperature detection elements 132*a* or 132*b*, and the liquid chamber 300 becomes short, and the accuracy of temperature detection can be improved. The temperature detection layer 108 is provided under the heating resistor layer 104. However, the temperature detection layer 108 may be apart on a plane if it is located near the temperature detection elements 132*a* or 132*b*. If the heating resistor layer 104 has a thin plate shape, the temperature change is largest at the center portion of the thin film. Hence, the temperature detection layer 108 desirably exists at least immediately under the center portion. The temperature detection layer 108 is formed by a single layer or a plurality of layers of an inorganic material or a metal having physical properties with an electric resistance value changing in accordance with the temperature.

As the metal material, for example, an Al—Cu alloy can be used. If the temperature detection layer 108 is a conductor, the temperature detection layer 108 itself may be used as a wiring to the temperature detection element 132*a* or 132*b*, or a wiring layer that is electrically independent of the wiring layer 105 configured to connect the heating resistor layer 104 may separately be provided. This is desirable because a ratio of the change of the electric resistance corresponding to the temperature change to the entire electric resistance can be set high by connecting the temperature detection layer 108 using another wiring whose change of the electric resistance value according to the temperature is smaller than that of the temperature detection layer 108 and whose electrical conductivity is higher than that of the temperature detection layer 108. Conversely, if the electric resistance value of the temperature detection layer 108 is high, the heating resistor layer 104 may be omitted because the temperature detection layer 108 can serve as the heating resistor layer. At any rate, when the ratio of the change of the electric resistance corresponding to the temperature change to the entire electric resistance is increased, even a small temperature change can be detected as a larger change.

More specifically, a material having physical properties with an electric resistance value more largely changing in accordance with the temperature is used for the temperature detection layer 108, or the width of the temperature detection layer 108 is decreased. Alternatively, the temperature detection layer 108 is arranged in a meandering shape to increase its line length. If the resistance of the temperature detection layer is increased in this way, the change of the electric resistance corresponding to the temperature change can be made relatively large. This makes it possible to improve the S/N ratio of the output signal and easily detect the behavior of the ink. The heating resistor layer 104 of each of the temperature detection elements 132*a* and 132*b*, that is, the heating resistor layer 104 that generates heat in association with (before) a temperature detection operation by the temperature detection elements 132*a* and 132*b* will be referred to as a "second electrothermal transducer" hereinafter. Note that the temperature detection layer 108 is also called a temperature detection element.

The second electrothermal transducer is connected, via a wiring, to the second drive circuit provided independently of the first drive circuit and configured to supply power that changes over time. The second drive circuit controls (ON/OFF) power supply to the second electrothermal transducer in accordance with a signal from the controller 600. The temperature detection layer 108 of each of the temperature detection elements 132*a* and 132*b* is connected to the controller 600 via a wiring, and an inspection start signal and power are supplied from the controller 600. When power is supplied to the temperature detection layer 108 of each of the temperature detection elements 132*a* and 132*b*, a voltage or a current that changes in accordance with the change of the resistance value corresponding to the temperature change is output. The output from the temperature detection layer 108 of each of the temperature detection elements 132*a* and 132*b* will be referred to as "the output of the temperature detection element" hereinafter.

When the output change is processed by a circuit such as an operational amplifier provided in the controller 600 via an external terminal, the behavior of the ink can be detected. Note that instead of processing the output signal from each of the temperature detection elements 132*a* and 132*b* by the controller 600, the processing may be performed using a processing circuit (not shown) provided on the element substrate 100, or both the controller 600 and the processing circuit provided on the element substrate 100 may be used.

As described above, since the second drive circuit connected to the second electrothermal transducer is independent of the first drive circuit connected to the first electrothermal transducer, the first electrothermal transducer and the second electrothermal transducer can be heated at individual timings by individual energies.

As ink behaviors detectable from the temperature change, whether the ink is normally discharged, whether the discharge direction of the ink is shifted (to be referred to as deviated hereinafter) from a desired direction, whether the ink is supplied to the liquid chamber after discharge, and the like can be detected. However, the present invention is not limited to these.

To detect whether the ink is normally discharged, the presence/absence of a steep change of the output signal of the temperature detection element 132 corresponding to abrupt temperature drop is judged. Hence, a phenomenon that the temperature change detected by the temperature detection element 132 changes between a case in which a part of a discharged ink droplet sticks to the surface layer of the electrothermal transducer 102 at the time of normal discharge and a case in which a part of a discharged ink droplet does not stick to the surface layer of the electrothermal transducer 102 at the time of a discharge failure is used.

Whether the discharge direction of the ink is deviated from a desired direction is judged based on whether the difference between the output signals from the two temperature detection elements 132*a* and 132*b* abruptly changes. If a deviation occurs, the position at which a part of a discharged ink droplet sticks to the surface layer of the electrothermal transducer of the element substrate 100 changes. Hence, the detection is performed using a phenomenon that the detected temperature change of the temperature detection element to which the part of the ink droplet sticks is abrupt as compared to that of another temperature detection element. More specifically, if the absolute value of the difference obtained by comparing the signals output from the temperature detection elements 132*a* and 132*b* is larger than a threshold, it can be judged that a deviation has occurred to the side of the change. Alternatively, when the times of changes of the signals output from the temperature detection elements 132*a* and 132*b* are compared, it can be judged that a deviation has occurred to the side where the change has quickly occurred.

At any rate, to detect whether the behavior of the ink is normal or abnormal, it is necessary to make the temperature change as steep as possible. To do this, before the temperature detection operation by the temperature detection elements 132*a* and 132*b*, such energy that does not cause foaming of the ink is given to the second electrothermal transducer to heat the temperature detection elements 132*a* and 132*b*. With this operation, the temperature change that occurs when a part of the ink discharged after heating sticks to the surface layer of the electrothermal transducer 102 of the element substrate 100 is made steeper than in a case in which the heating is not performed.

Hence, in this embodiment, the first drive circuit configured to supply power to the first electrothermal transducer and the second drive circuit configured to supply power to the second electrothermal transducer are provided independently. When the two drive circuits are independently operated, the temperature detection elements 132*a* and 132*b* can detect the behavior of the ink at a high sensitivity as compared to a case in which the second electrothermal transducer is not provided. At this time, if the ink on the temperature detection elements 132*a* and 132*b* is foamed by giving energy sufficient for ink foaming before ink foaming on the electrothermal transducer 102, this is not desirable because there is a concern that, for example, film boiling changes to nuclear boiling, and this affects foaming of the liquid on the electrothermal transducer 102. Hence, energy that is as large as possible but does not foam the ink is desirably given to the second electrothermal transducer because the temperature change becomes steep accordingly.

To only determine the pretense/absence of ink discharge, the number of temperature detection elements corresponding to one electrothermal transducer can be one or multiple. However, to detect a deviation, as described above, it is desirable that a plurality of temperature detection elements are provided in correspondence with one electrothermal transducer, and the direction of the plurality of temperature detection elements and the electrothermal transducer is aligned with the direction of the deviation to be detected.

For example, if a deviation has occurred in a direction perpendicular to the conveyance direction of the print medium on which an ink droplet discharged from the printhead lands, a complement is particularly needed because a stripe-like density unevenness that is visually noticeable occurs on a printed image. In this case, the temperature detection elements 132*a* and 132*b* are desirably provided at positions offset in the direction orthogonal to the conveyance direction of the print medium on both sides of the electrothermal transducer in a planar view of the element substrate.

Even if the discharged ink droplet deviates in the conveyance direction of the print medium, image quality similarly lowers although it is less noticeable. Hence, to quickly detect it and perform a recovery operation, the temperature detection elements are desirably provided at positions offset in the conveyance direction of the print medium on both sides of the electrothermal transducer in a planar view of the element substrate.

In a case where the deviation direction is unpredictable, the temperature detection elements may be provided both at positions offset in the conveyance direction of the print medium on both sides of the electrothermal transducer and at positions offset in the direction perpendicular to the conveyance direction of the print medium. Alternatively, temperature detection elements may be provided in three directions viewed from the electrothermal transducer so three temperature detection elements and one electrothermal transducer are not located on a line. Here, a temperature detection element corresponding to one electrothermal transducer indicates a temperature detection element for which, concerning a certain electrothermal transducer, an electrothermal transducer closest to each temperature detection element is the electrothermal transducer. Note that if a plurality of electrothermal transducers are equidistantly arranged, temperature detection elements corresponding to one electrothermal transducer may be any desired combination of these.

Figure 5A:
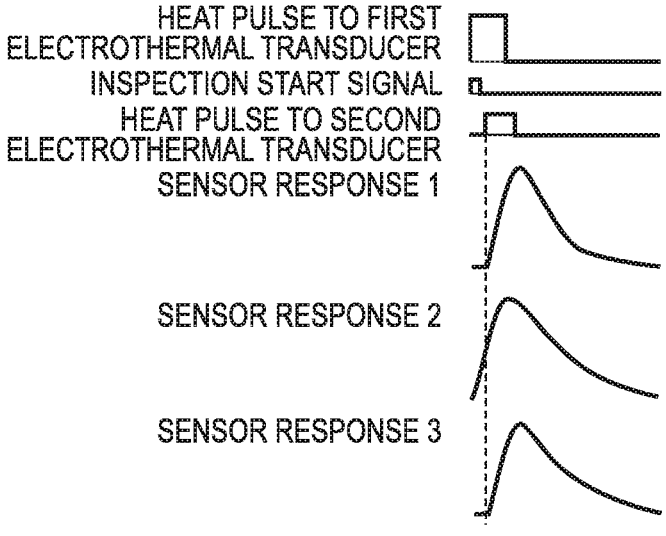
FIGS. 5A, 5B, and 5C are timing charts each showing a heat pulse used to heat an electrothermal transducer, an inspection start signal of a temperature detection layer, and an output signal waveform of the temperature detection layer.
Figure 5B:
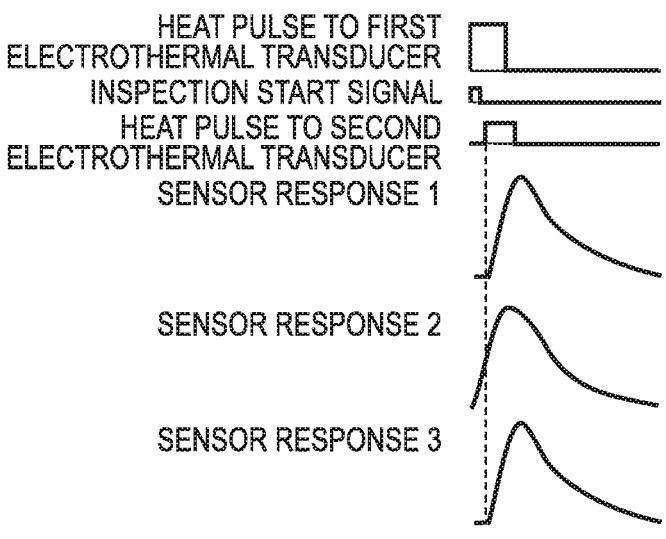
Figure 5C:
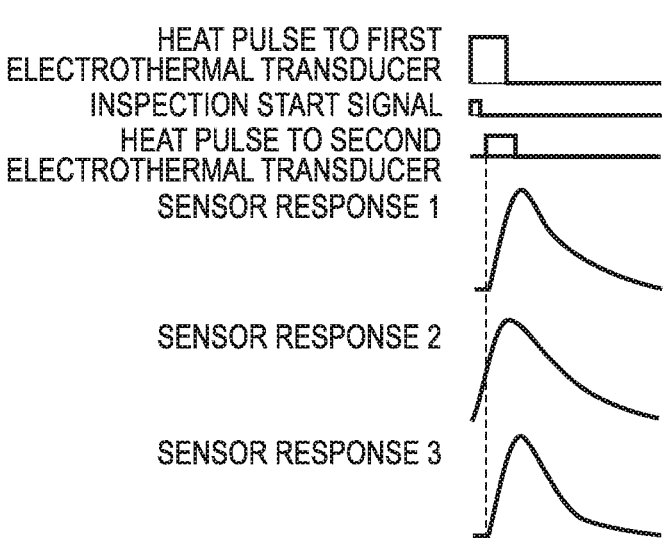

FIGS. 5A to 5C are timing charts each showing a heat pulse used to heat an electrothermal transducer, an inspection start signal of a temperature detection layer, and an output signal waveform (to be referred to as a sensor response hereinafter) of the temperature detection layer. In this example, the temperature detection layer 108 is formed immediately under the layer, in which the heating resistor layer 104 of the electrothermal transducer 102 is formed, thereby directly detecting the temperature of the electrothermal transducer 102.

In FIGS. 5A to 5C, sensor response 1 represents a waveform after the output signal from the temperature detection layer 108 of one temperature detection element 132*a* at the time of ink behavior detection of the printhead 3 is processed. Waveform sensor response 2 represents a waveform after the output signal from the temperature detection layer 108 of the electrothermal transducer 102 at the time of ink behavior detection of the printhead 3 is processed. Sensor response 3 represents a waveform after the output signal from the temperature detection layer 108 of the other temperature detection element 132*b* at the time of ink behavior detection of the printhead 3 is processed. Note that in FIGS. 5A to 5C, output waveforms from before heating to after cooling of the electrothermal transducer are shown for the sake of description. Actually, it is sufficient to detect the outputs from the temperature detection elements 132*a* and 132*b* only immediately after ink droplet sticking when the difference between waveforms, which is needed for discharge failure detection or deviation detection, appears.

Figure 6A:
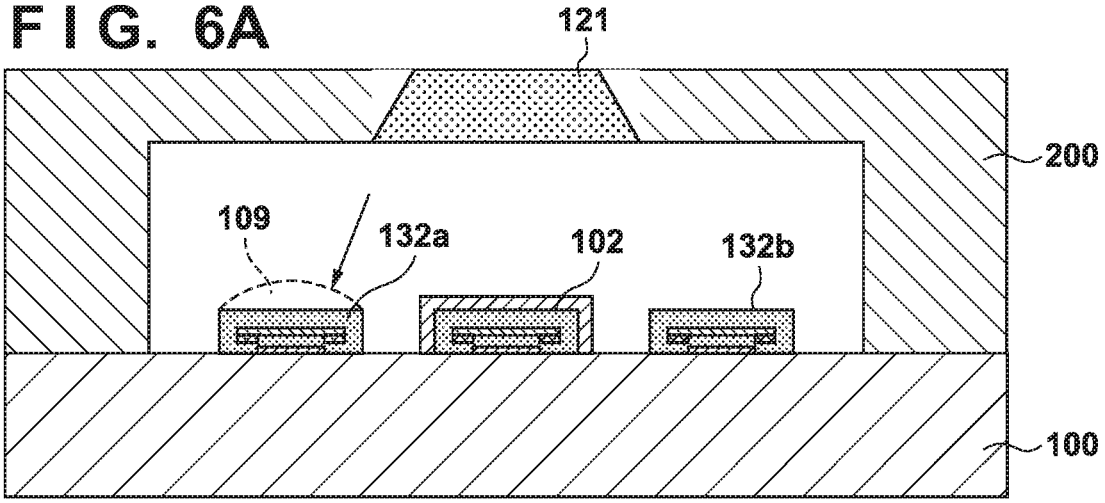
FIGS. 6A, 6B, and 6C are views showing the state of drop of a part of an ink droplet when an ink discharge operation is performed by applying a heat pulse to heat the electrothermal transducer in correspondence with FIGS. 5A, 5B, and 5C.
Figure 6B:
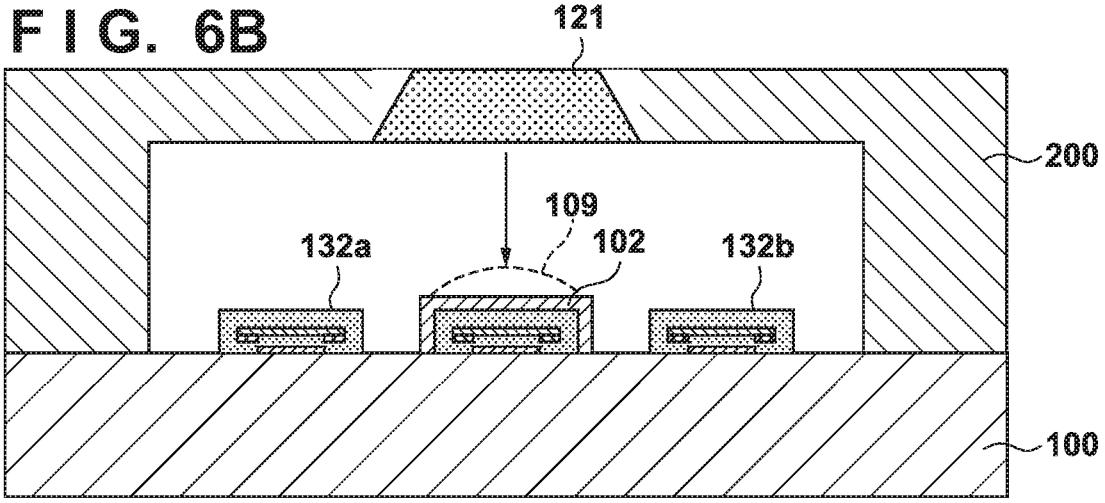
Figure 6C:
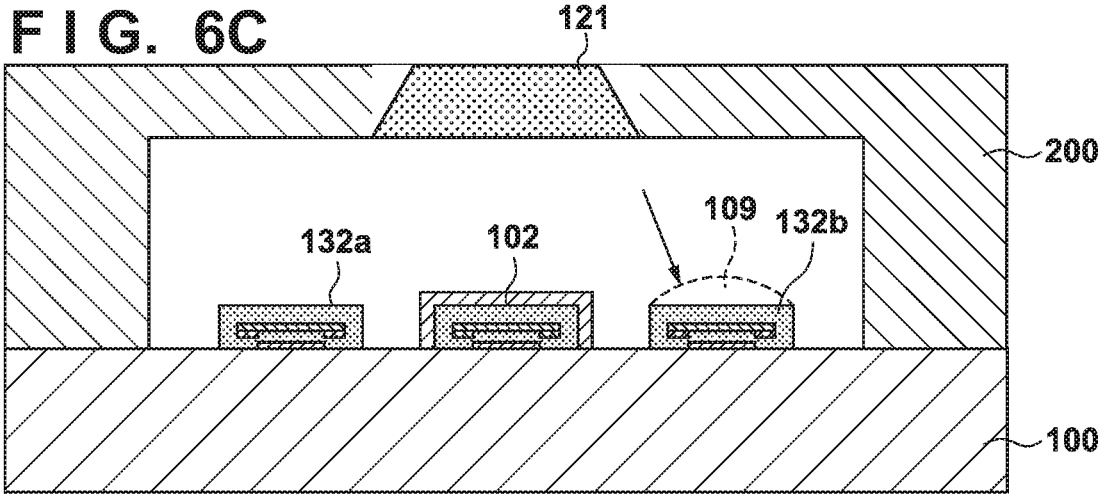
Figure 7A:
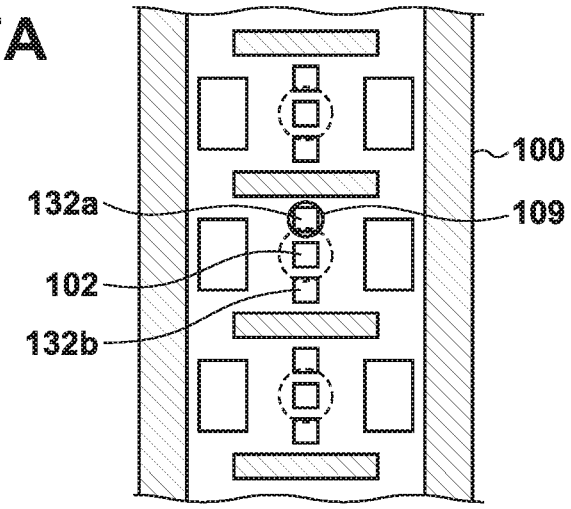
FIGS. 7A, 7B, and 7C are views showing the state of drop of a part of an ink droplet when an ink discharge operation is performed in correspondence with FIGS. 6A, 6B, and 6C.
Figure 7B:
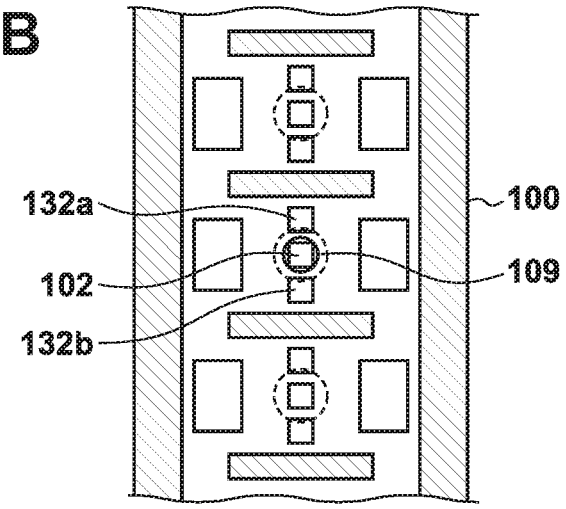
Figure 7C:
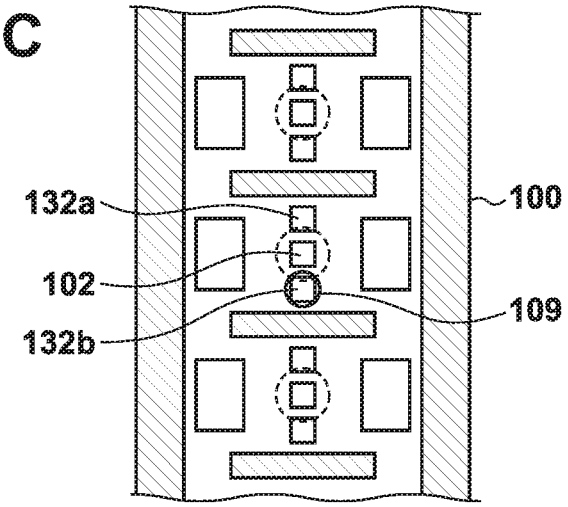

FIGS. 6A to 6C are views showing the state of drop of a part of an ink droplet when an ink discharge operation is performed by applying a heat pulse to heat the electrothermal transducer in correspondence with FIGS. 5A to 5C, and FIGS. 7A to 7C are views showing the state of drop of a part of an ink droplet when an ink discharge operation is performed in correspondence with FIGS. 6A to 6C. Note that FIGS. 6A to 6C are sectional views of the element substrate, and FIGS. 7A to 7C are perspective views of the element substrate viewed from the upper side of an orifice. FIGS. 5A, 5B, and 5C correspond to FIGS. 6A, 6B, and 6C and FIGS. 7A, 7B, and 7C, respectively.

FIG. 5A shows sensor responses in a case in which a part of a droplet has stuck to the temperature detection element 132*a* at the time of ink behavior detection of the printhead 3. FIGS. 6A and 7A each show a state in which an ink droplet 109 has dropped and stuck to the temperature detection element 132*a*. In this case, sensor response 1 represents the output waveform from the temperature detection element 132*a* to which a part of the ink droplet has stuck at the time of ink discharge, and sensor response 3 represents the output waveform from the temperature detection element 132*b* to which an ink droplet has not stuck because of an ink discharge failure or a discharge deviation. In sensor response 1, since a part of the discharged ink droplet has stuck near the surface layer of the temperature detection element 132*a*, the temperature of the temperature detection element 132*a* abruptly drops. On the other hand, in sensor response 3, since the ink droplet has not stuck near the surface layer of the temperature detection element 132*b*, the temperature of the temperature detection element 132*b* moderately lowers. For this reason, as is apparent from comparison between the two responses, the presence/absence of a deviation appears as the difference representing whether an abrupt change exists in the output signals of the temperature detection elements 132*a* and 132*b*.

To make the temperature changes in the temperature detection elements 132*a* and 132*b* as steep as possible, it is optimum that the heat pulse to the second electrothermal transducer has a characteristic of ending heating such that the ink droplet sticks at a timing after the elapse of a time for making heat propagate to the temperature detection layer 108 after the end of heating. Here, the elapse of a time for making heat propagate to the temperature detection layer 108 means a time needed until the temperature detection layer 108 reaches the highest temperature after the end of heating. To do this, the energy to heat the second electrothermal transducer is adjusted to be smaller as compared to the energy to the first electrothermal transducer.

More specifically, if heating powers to the first electrothermal transducer and the second electrothermal transducer equal, heating of the first electrothermal transducer is started first. Alternatively, control is performed to weaken heating power to the second electrothermal transducer as compared to the first electrothermal transducer by making the heating start timing of the first electrothermal transducer match that of the second electrothermal transducer. As for the end of heating, heating of the second electrothermal transducer is desirably ended later than the first electrothermal transducer. The time width of heating of the temperature detection elements 132*a* and 132*b* exerts a small influence on the temperature change. However, to improve the energy efficiency, heating is desirably performed in a short time using large power as much as possible in terms of circuit. To implement these, an arrangement capable of heating the first electrothermal transducer and the second electrothermal transducer at independent timings using independent energy amounts is necessary.

FIG. 5B shows the responses of the sensors in a case in which a part of an ink droplet has stuck to the electrothermal transducer 102 of the printhead 3. FIGS. 6B and 7B each show a state in which an ink droplet 109 has dropped and stuck to the electrothermal transducer 102. As shown in FIG. 5B, in sensor response 1 and sensor response 3, since the ink droplet has stuck to neither of the temperature detection elements 132*a* and 132*b*, the temperature of the temperature detection elements 132*a* and 132*b* moderately lowers. Such a change is different from the characteristic of the output signal of the temperature detection element 132*a* shown in FIG. 5A, which represents abrupt temperature drop. On the other hand, in sensor response 2, since a part of the ink droplet sticks to the electrothermal transducer 102, temperature drop corresponding to this is abrupt.

FIG. 5C shows the responses of the sensors in a case in which a part of an ink droplet has stuck to the other temperature detection element 132*b* at the time of ink behavior detection of the printhead 3, unlike FIG. 5A. FIGS. 6C and 7C each show a state in which an ink droplet 109 has dropped and stuck to the temperature detection element 132*b*. As compared with FIG. 5A, the output characteristic is the same as in FIG. 5A except that it is replaced with the output characteristic of the temperature detection element 132*b* to which the ink droplet has stuck.

Figure 8:
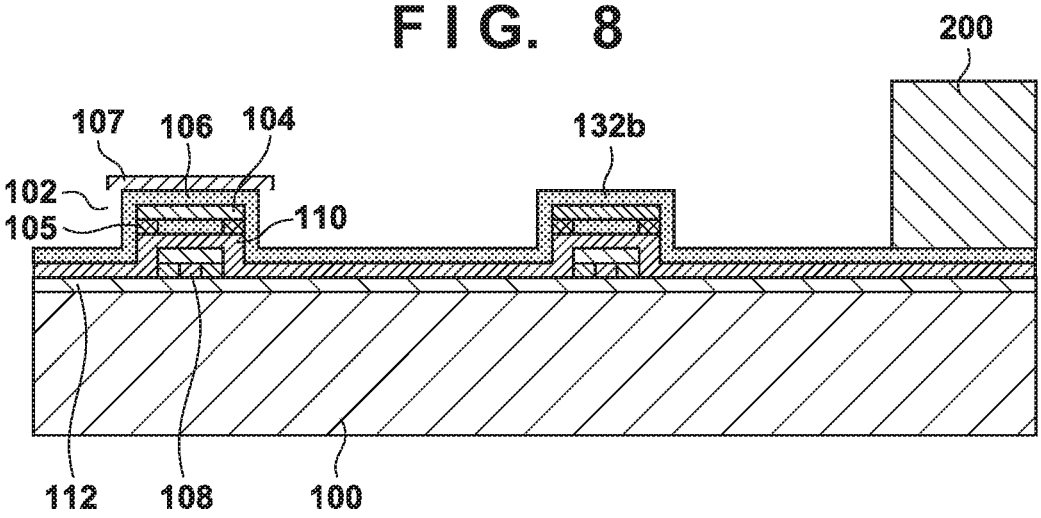
FIG. 8 is a sectional view for explaining the sectional structure of one electrothermal transducer and one temperature detection element and the positional relationship between them.

FIG. 8 is a sectional view for explaining the sectional structure of one electrothermal transducer and one temperature detection element and the positional relationship between them. FIG. 8 shows only the vicinity of the electrothermal transducer 102 and the temperature detection element 132*b* shown in FIG. 4B, and the remaining portions are not illustrated because they are the same as in FIG. 4B.

An insulating layer 110 shown in FIG. 8 is a layer configured to insulate layers such as the heating resistor layer 104, the wiring layer 105, and the temperature detection layer 108 to which a current flows. The insulating layer 110 is formed by a single layer or a plurality of layers of an insulator such as SiO or BPSG (Boro-Phospho Silicate Glass). A heat-insulating layer 112 is a heat-insulating layer configured to prevent excessive diffusion of heat to the element substrate 100, and is formed by a single layer or a plurality of layers of a low thermal conductivity material such as SiO. In a time scale of a discharge frequency, thermal design is made such that heat hardly propagates to the lower side of the heat-insulating layer 112.

Conductive layers such as the wiring layers 105 and the temperature detection layers 108 of each of the electrothermal transducer 102 and the temperature detection elements 132*b* are separated by the liquid chamber or nonconductive layers. This prevents noise occurrence when the temperature detection element 132*b* are heated by the electrothermal transducer 102.

Hence, the vertical distance from the uppermost layer of the temperature detection element 132 to the temperature detection layer 108 is desirably made shorter than the horizontal distance of the separating portion between the electrothermal transducer 102 and the temperature detection element 132*b*. In addition, the temperature detection layer 108 is provided on the surface layer side of the heat-insulating layer 112. This is because heat does not propagate to the lower side of the heat-insulating layer 112.

Hence, according to the above-described embodiment, two temperature detection elements are arranged for one electrothermal transducer, a heating resistor layer is provided in each of the electrothermal transducer and the temperature detection elements, and drive circuits capable of driving these independently of each other are provided. Since this makes it possible to drive the electrothermal transducer and the temperature detection elements at timings independent of each other and detect a temperature change under a condition that maximizes the temperature change of the temperature detection element in the ink discharge operation, an ink discharge failure can more correctly be detected.

In addition, when two temperature detection elements are arranged in correspondence with one electrothermal transducer, and the characteristics of temperature changes detected by the two temperature detection elements are thus compared, the occurrence of a deviation in the direction of arranging the two temperature detection elements can be detected, or the direction of the deviation can be determined. As described above, according to this embodiment, it is possible to grasp the behavior of discharged ink.

Note that in the above-described embodiment, the printhead that discharges ink and the printing apparatus have been described as an example. However, the present invention is not limited to this. The present invention can be applied to an apparatus such as a printer, a copying machine, a facsimile apparatus including a communication system, or a word processor including a printer unit, and an industrial printing apparatus complexly combined with various kinds of processing apparatuses. In addition, the present invention can also be used for the purpose of, for example, biochip manufacture, electronic circuit printing, color filter manufacture, or the like.

The printhead described in the above embodiment can also be considered as a liquid discharge head in general. The substance discharged from the head is not limited to ink, and can be considered as a liquid in general.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-131396, filed Jul. 16, 2019, which is hereby incorporated by reference herein in its entirety.

What is claimed is:

1. An element substrate comprising:

a first electrothermal transducer configured to generate heat to discharge a liquid;

a second electrothermal transducer located in one side of the first electrothermal transducer;

a third electrothermal transducer located in the other side of the first electrothermal transducer;

a first temperature detection element located in the one side of the first electrothermal transducer; and a second temperature detection element located in the other side of the first electrothermal transducer, wherein the first, second and third electrothermal transducers and the first and second temperature detection elements are provided in one chamber, and wherein, in a planar view of the element substrate, the second electrothermal transducer and the first temperature detection element overlap with each other, and the third electrothermal transducer and the second temperature detection element overlap with each other.

2. The element substrate according to claim 1, wherein the element substrate has a multilayer structure, and the first and second temperature detection elements are formed in a lower layer of the first, second, and third electrothermal transducers.

3. The element substrate according to claim 2, wherein another temperature detection element different from the first and second temperature detection elements is formed in a lower layer of the first electrothermal transducer.

4. The element substrate according to claim 1, further comprising:

a first drive circuit configured to control supply of power to the first electrothermal transducer; and a second drive circuit configured to control supply of power to the second and third electrothermal transducers, wherein the first drive circuit and the second drive circuit can be driven independently of each other.

5. The element substrate according to claim 1, wherein the first and second temperature detection elements are arranged in a direction orthogonal to a direction of arranging the first, second, and third electrothermal transducers.

6. The element substrate according to claim 1, wherein the first and second temperature detection elements are arranged in each of a direction of arranging the first, second, and third electrothermal transducers and a direction orthogonal to the direction of arranging the first, second, and third electrothermal transducers.

7. The element substrate according to claim 1, wherein the first and second temperature detection elements are arranged in three directions near the first, second, and third electrothermal transducers.

* * * * *